US005744767A

United States Patent [19]

Wecke et al.

[11] Patent Number: 5,744,767

[45] Date of Patent: Apr. 28, 1998

[54] RADIUS ACTUATOR WITH ADJUSTABLE SLANTED DISPOSITION OF AN OPERATING KEY FOR OPERATION OF A SAFETY SWITCH

[75] Inventors: Rolf Wecke, Bückeburg; Roland Mönnings, Porta Westfalica, both of Germany

[73] Assignee: Hans Bernstein Spezialfabrik Für Schaltkontakte GmbH & Co., Porta Westfalica, Germany

[21] Appl. No.: 730,676

[22] Filed: Oct. 11, 1996

[30] Foreign Application Priority Data

Oct. 13, 1995 [DE] Germany ..... 295 16 230 U

[51] Int. Cl.[6] ..... H01H 3/00

[52] U.S. Cl. ..... 200/17 R

[58] Field of Search ..... 200/43.01, 17 R, 200/50 R, 50 A, 43.04, 43.05, 43.06, 43.07, 43.08

[56] References Cited

U.S. PATENT DOCUMENTS 4,044,215 8/1977 Leibinger et al. ..... 200/318

5,245,143 9/1993 James et al. ..... 200/43.08

5,516,993 5/1996 Wecke et al. ..... 200/17 R 5,622,253 4/1997 Wecke et al. ..... 200/43.08

*Primary Examiner*—Edward Tso

*Attorney, Agent, or Firm*—Henry M. Feiereisen

[57] ABSTRACT

A radius actuator for operating a safety switch, includes a holder and a spring-biased operating key which is secured in the holder by a carrier member and moveable between a slanted initiation position and a switch-actuating position, with the operating key being tiltable relative to the carrier member about a first pivot axis and lockable in place. A base plate is attached to the key-distant end of the carrier member such that the carrier member is tiltable about a second pivot axis and lockable in place, whereby the second pivot axis is in offset disposition to the first pivot axis by 90°, thereby allowing a slanted positioning of the operating key over a wide range. The base plate is displaceable within the holder in direction of the longitudinal axis of the carrier member and tiltable relative thereto in opposition to the force exerted on the base plate by a spring which is received in the holder.

6 Claims, 3 Drawing Sheets

RADIUS ACTUATOR WITH ADJUSTABLE SLANTED DISPOSITION OF AN OPERATING KEY FOR OPERATION OF A SAFETY SWITCH

BACKGROUND OF THE INVENTION

The present invention refers to a radius actuator for a safety switch, and in particular to a radius actuator including a mounting and a spring-loaded operating key that is movable between an initiation position and a switch-operating position.

Safety switches are used to cut the current supply when, for example, a protective cover is removed from an equipment or a machine or when equipment access doors and cabinet doors are opened. Such safety switches typically are formed with a plurality of access openings that face in different directions for entry of a radius actuator to operate the switch. The actuator is suitably secured to a flap, door, or lid at a predetermined distance from the flap axis or rotational axis thereof and moves together with the door, flap or the like.

Such radius actuators are utilized when the actuator can only be affixed to the door flap or lid at a small swiveling radius relative to the safety switch, with the radius actuator being configured as to occupy a slanted position (initiation position) in relation to the safety switch in the initiation phase. Thus, the radius actuator can readily enter the safety switch through its access opening at a small swiveling radius, but still can assume an actuating position that is substantially perpendicular to the switch element being actuated upon further travel for operation of e.g. a switch wheel of such a safety switch. The force exerted by the spring effects a return of the operating key of the radius actuator into the initiation position after exiting the safety switch.

A drawback of conventional radius actuators is the limited adjustment of the operating key as the operating key can be pivoting about only one axis to occupy a slanted initiation position.

SUMMARY OF THE INVENTION

It is an object of the present invention to provide an improved radius actuator, obviating the afore-stated drawbacks.

In particular, it is an object of the present invention to provide an improved radius actuator of this general type which is convenient to operate and allows a pre-adjustment of the operating key to occupy a slanted initiation position for all conceivable applications of use.

These objects and others which will become apparent hereinafter are attained in accordance with the present invention by providing a holder and an operating key which is secured to the holder for movement of the operating key between a slanted initiation position and a switch-actuating position via a carrier member such that the operating key is tiltable about a first pivot axis with regard to the carrier member and lockable in place, with a base plate being attached to the operating key distal end of the carrier member such that the carrier member is tiltable about a second pivot axis and lockable in place, with the second pivot axis being in offset disposition to the first pivot axis by 90°, and by disposing a spring in the holder to load the base plate in such a manner that the base plate is displaceable in the holder in opposition to the action of the spring in direction of the longitudinal axis of the carrier member and tiltable relative to the longitudinal axis.

A radius actuator in accordance with the present invention allows a slanted positioning of the operating key for every conceivable use situation. The provision of only a single spring within the holder allows a tilting of the carrier member to a necessary extent during introduction of the operating key into the access opening of the safety switch while a withdrawal of the operating key from the access opening and thus a full separation of the radius actuator from the safety switch returns the carrier member together with the attached operating key into its initiation position.

As the carrier member is spring-biased in its axial direction, forces caused e.g. by an unintended impact upon the operating key are absorbed so that the risk of damage is significantly reduced.

According to another feature of the present invention, the carrier member is configured as fork head at formation of a slit for resiliently receiving the operating key, with a pin traversing aligned bores in the fork head for defining the first pivot axis. In order to lock the operating key in place in a selected slanted position relative to the carrier member, the fork head can be clamped by a locking screw which traverses aligned bores in the fork head and is received in an arcuated oblong hole of the operating key. The second pivot axis for allowing a tilting of the operating key through adjustment of the carrier member is effected by a screw fastener which extends through a collar of the base plate and a bore in a rear mounting piece of the carrier member and is received in a threaded collar-opposite bore of the base plate. Preferably, the base plate is of square configuration and received in a square recess of the holder so as to be displaceable and tiltable within the holder while being prevented from executing a rotational motion. As the base plate is made of elastic material, the mounting piece of the carrier member can be locked in place in each possible tilting position within the opening of the base plate as a consequence of an elastic deformation of the base plate.

Suitably, the key-distant backside of the holder is closed by a ring-shaped plate which is threadably received in the holder, with the spring extending between the base plate and the ring shaped plate.

BRIEF DESCRIPTION OF THE DRAWING

The above and other objects, features and advantages of the present invention will now be described in more detail with reference to the accompanying drawing in which.

DETAILED DESCRIPTION OF PREFERRED EMBODIMENTS

Figure 1:
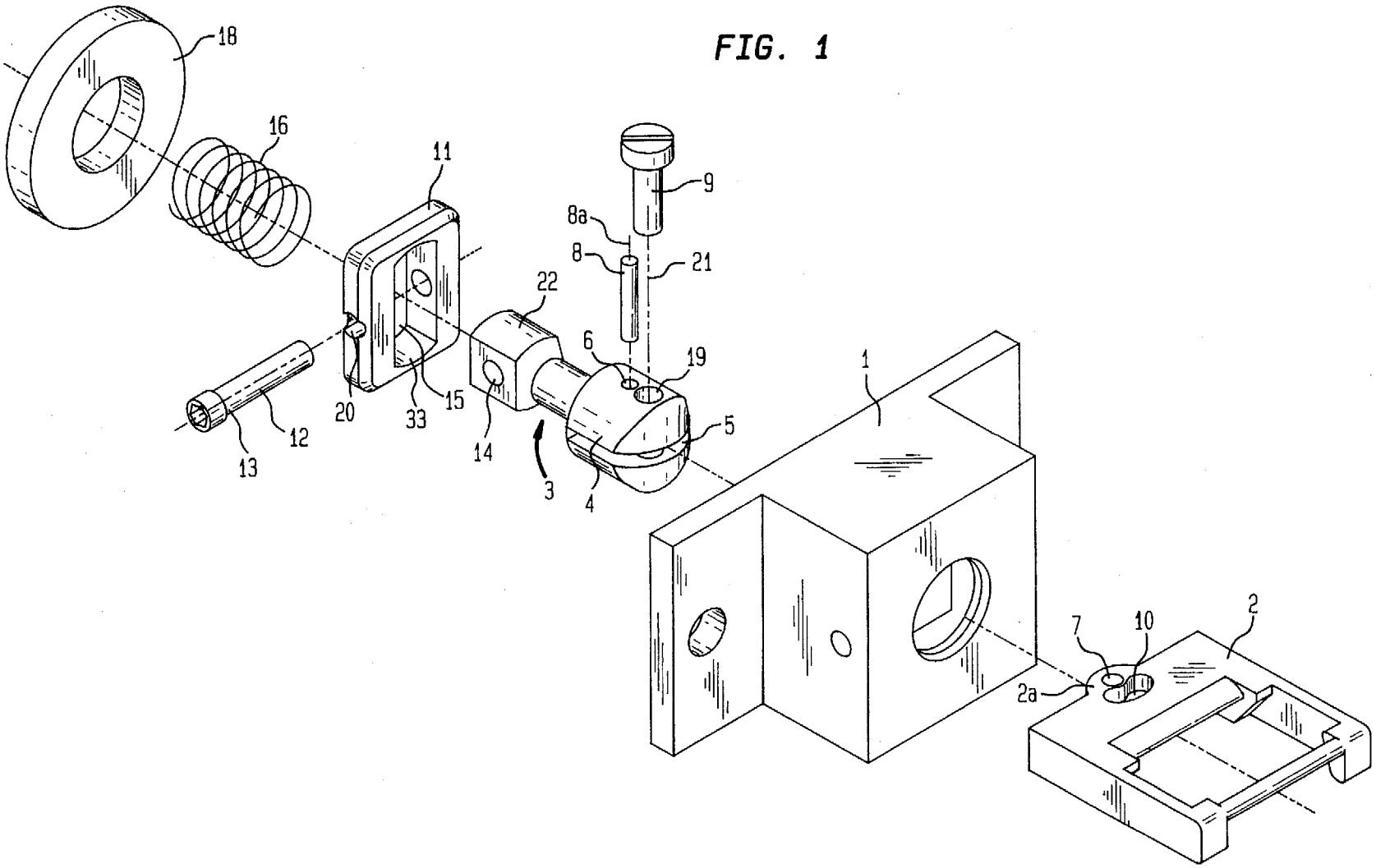
FIG. 1 is an exploded perspective illustration of one embodiment of a radius actuator according to the present invention.

Throughout all the Figures, the same or corresponding elements are always indicated by the same reference numerals.

Turning now to the drawing, and in particular to FIG. 1, there is shown an exploded perspective illustration of one embodiment of a radius actuator in accordance with the present invention for operation of a safety switch. The radius actuator essentially includes a housing-like holder 1 and a spring-biased operating key 2 in form of a shackle or stirrup, having a holder-distant forward operating end for engagement with matching cam contours formed on a switch wheel inside the safety switch. The safety switch and its components, such as the switch wheel and electric components and circuitry, do not form part of the present invention and thus are not shown in detail for sake of simplicity. An exemplified construction and manner in which an operating key is operatively and functionally incorporated in a radius actuator is described in commonly assigned copending earlier patent application, application Ser No. 08/538,412, filed Oct. 2, 1995 by a different inventive entity, and entitled "Radius Actuator for a Safety Switch", the disclosure of which is incorporated herein by reference.

The operating key 2 is received in the holder 1 for movement between a slanted initiation position and a switch-operating position by means of a carrier member, generally designated by reference numeral 3 and having one end secured to the operating key 2 and another end projecting into the holder 1. In the area of attachment to the operating key 2, the carrier member 3 is formed as a two-prongs fork head 4 at formation of a slot 5 in which an arched rearward lug 2*a* of the operating key 2 is received. A bore 6 extends through the fork head 4 transversely with respect to the slot 5 and, in the assembled state of the radius actuator, is in alignment with a receiving bore 7 formed in the lug 2*a* of the operating key 2. Traversing the aligned bores 6, 7 is a pin 8 to define a pivot axis 8*a* about which the operating key 2 is tiltable relative to the carrier member 3. At a distance to the bore 6, the fork head 4 is provided with a further throughbore 19 for receiving a locking screw 9 which is threadably engageable in an arcuated oblong hole 10 of the operating key 2 to allow a clamping of the fork head 4 in a direction perpendicular to the slot 5 so that the operating key 9 can be locked in place when occupying a selected slanted position relative to the fork head 4. As a result of the arcuated oblong hole 10, the operating key 2 can be tilted about the pin 8 to a certain degree relative to the longitudinal axis of the carrier member 3 and thus can be secured in every possible tilting position relative to the carrier member 3.

Figure 2:
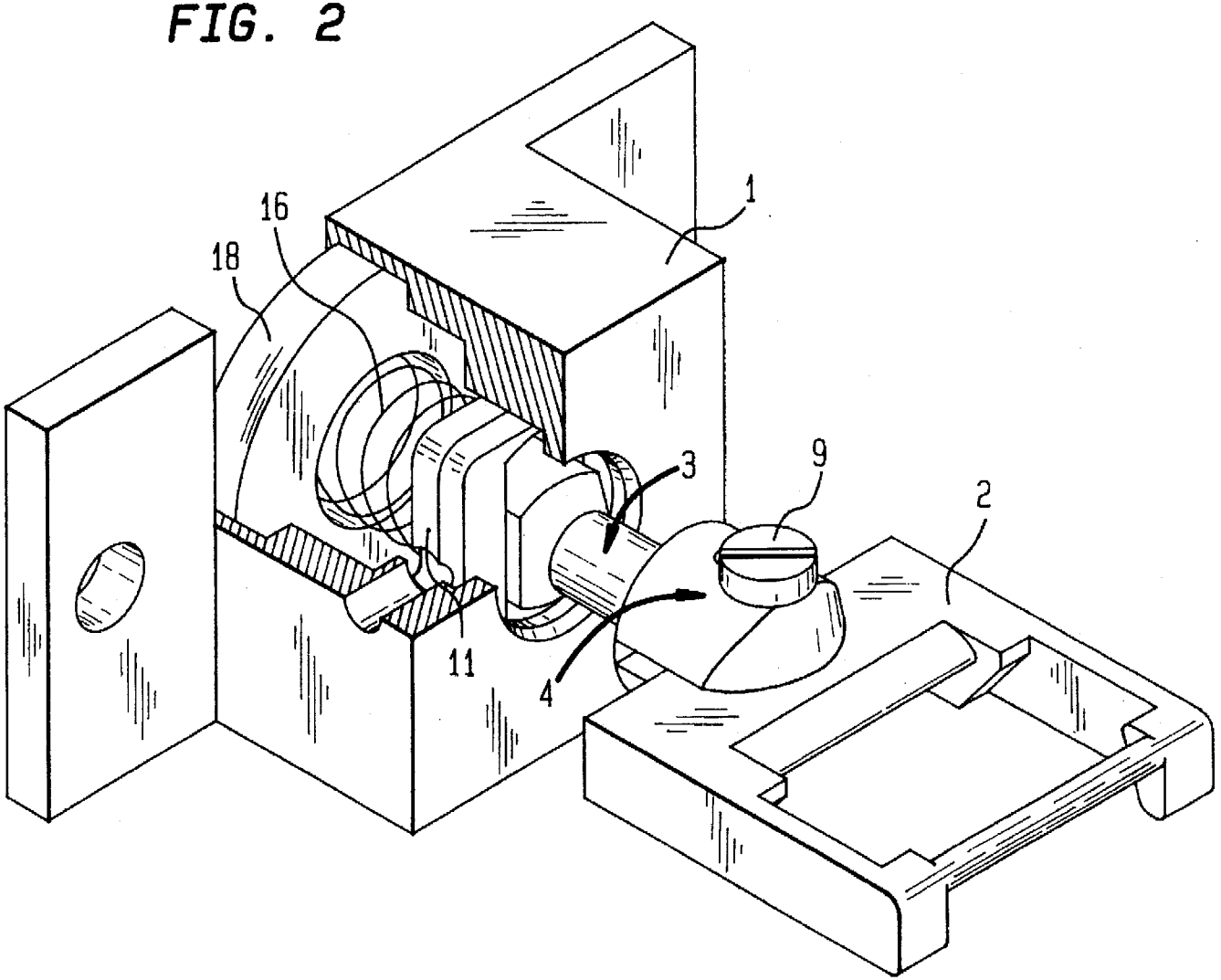
FIG. 2 is a perspective illustration of the assembled radius actuator of FIG. 1, with the holder being partially broken up to show the interior parts of the radius actuator.
Figure 5:
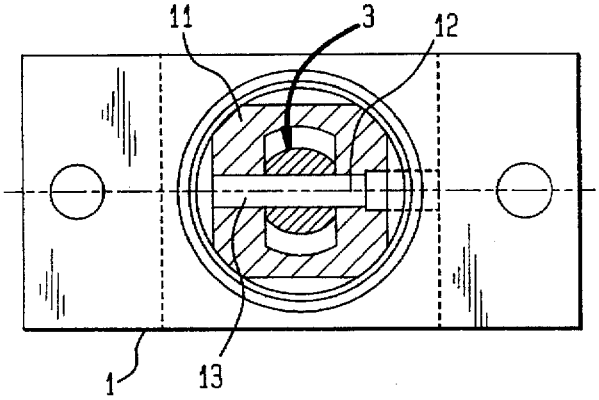
FIG. 5 is a sectional view of the radius actuator taken along the line V—V in FIG. 4.

At a distance to the fork head 4, the carrier member 3 is formed with a rearward mounting piece 22 which is received within the holder 1 in an opening 15 of a base plate 11, as shown in FIG. 2. The base plate 11 is made of elastic material and the opening 15 of the base plate 11 is of rectangular configuration, with the mounting piece 22 being of complementary shape so that the mounting piece 22 is tiltable therein about a second pivot axis 12 relative to the base plate 11 and lockable in place in each position. The pivot axis 12 is formed by a screw fastener 13 which extends through a collar 20 of the base plate 11 and a throughbore 14 formed in the mounting piece 22 of the carrier member 3 and is received in a threaded bore 30 of the base plate 11 in opposition to the collar 20, as also indicated in FIG. 5. Thus, the second pivot axis 12 is offset by 90° relative to the pivot axis 21 as defined by the pin 8. As a result of the elastic properties of the base plate 11, the mounting piece 22 of the carrier member 3 can be locked in place in each possible tilting position within the opening 15 through elastic deformation of the base plate 11. The clamping action of the mounting piece 22 can be further enhanced through formation of a slot 33 that ensures a clamping also at greater tolerances between the mounting piece 22 and the opening 15.

The base plate 11 is acted upon within the holder 1 in direction of the longitudinal axis of the carrier member 3 by a spring 16 which extends between the base plate 11 and a ring shaped plate 18 threadably engaged within the key-distant backside of the holder 1, as shown in FIG. 2.

Figure 3:
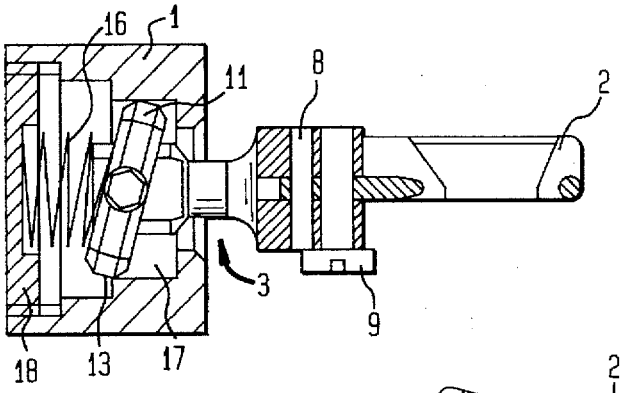
FIG. 3 is a longitudinal section of the radius actuator in a switch-operating position.

As shown e.g. in FIG. 3, the base plate 11 is of square configuration and received in a complementary recess 17 formed within the holder 1 such that the base plate 11 can be displaced in an axial direction but is prevented from executing a rotational motion, whereby the base plate 11 is so dimensioned as to allow a tilting within the recess 17 in relation to the longitudinal axis of the carrier member 3.

Figure 4:
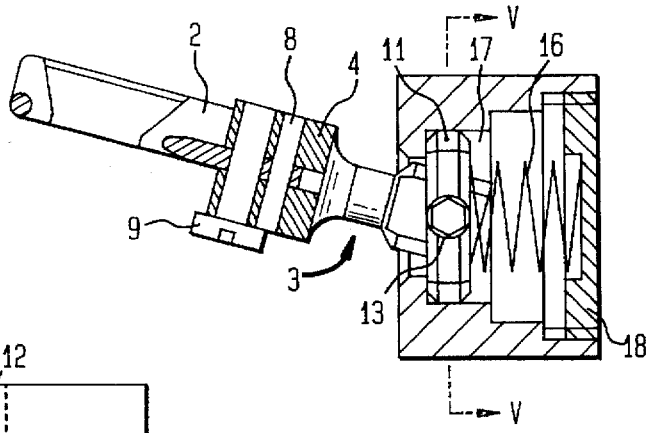
FIG. 4 is a longitudinal section of the radius actuator in a slanted initiation position.

FIG. 3 shows a longitudinal section of the radius actuator in a switch-operating position in which the operating key 2 extends in alignment with the longitudinal axis of the carrier member 3. In this case, the carrier member 3 is tilted in a desired direction relative to the base plate 11 and fixedly secured in this swinging position to the base plate 11. FIG. 4 shows the slanted initiation position of the radius actuator, i.e. the position in which the entire radius actuator is positioned outside of the safety switch. In this slanted initiation position, the operating key 2 can be inserted into the safety switch to occupy the switch-operating position, as shown in FIG. 3. During this movement, the base plate 11 is tilted within the holder 1 in opposition to the spring force applied by the spring 16. When separating the radius actuator from the safety switch, the spring 16 returns to the initial position to move the base plate 11 into the straight position as shown in FIG. 4 in which the operating key 2 is returned to the slanted disposition.

Figure 6:
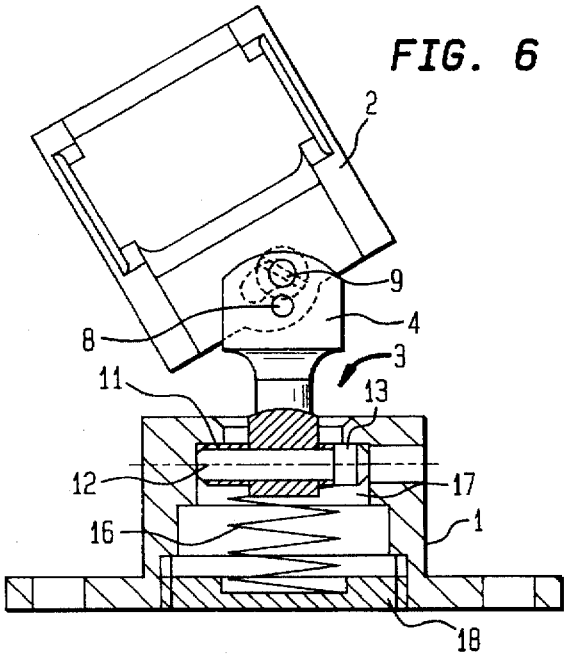
FIG. 6 is a partially sectional plan view of the radius actuator, in another slanted initiation position.

FIG. 6 is a partially sectional plan view of the radius actuator in which the operating key 2 occupies a slanted initiation position which is effected by tilting the operating key 2 relative to the carrier member 3. After the operating key 2 has been adjusted to a selected slanted initiation position, the locking screw 9 is tightened so that the operating key 2 is fixed in place. Upon introduction of the radius actuator into the access opening of the safety switch and ensuing disposition of the operating key 2 in the switch-operating position, the carrier member 3 is tilted relative to its longitudinal axis. This is possible as a result of the spring 16 that acts upon the base plate 11. After being withdrawn from the safety switch, the radius actuator occupies again the position shown in FIG. 6.

As the base plate 11 is displaceable within the recess 17 in opposition to the action of the spring 16, an unattended impact upon the operating key 2 can be resiliently absorbed so that the risk of destruction of the radius actuator is minimized.

While the invention has been illustrated and described as embodied in a radius actuator for a safety switch, it is not intended to be limited to the details shown since various modifications and structural changes may be made without departing in any way from the spirit of the present invention.

What is claimed as new and desired to be protected by Letters Patent is set forth in the appended claims:

We claim:

1. A radius actuator for operating a safety switch; comprising:

a holder, a spring-biased operating key; and mounting means securing the operating key to the holder for movement of the operating key between a slanted initiation position and a switch-actuating position, said mounting means including a carrier member defining a longitudinal axis and having one end connected to the operating key and another end received in the holder such that the operating key is tiltable about a first pivot axis with regard to the carrier member and lockable in place, a base plate attached to the other end of the carrier member such that the carrier member is tiltable about a second pivot axis and lockable in place, with the second pivot axis being in offset disposition to the first pivot axis by 90°, and a spring received in the holder and loading the base plate, said base plate being displaceable in the holder in opposition to the action of the spring in direction of the longitudinal axis of the carrier member and tiltable relative to the longitudinal axis.

2. The radius actuator of claim 1 wherein the one end of the carrier member is configured as fork head at formation of a slit for partially receiving the operating key, said mounting means including a pin traversing first aligned bores in the fork head and a bore in the operating key for defining the first pivot axis, and a locking screw traversing second aligned bores in the fork head for engagement in an arcuated oblong hole of the operating key to clamp the fork head and thereby to lock the operating key in place.

3. The radius actuator of claim 1 wherein the base plate is formed with an opening for receiving the other end of the carrier member, said mounting means further including a screw fastener traversing aligned bores in the base plate and a bore in the carrier member for defining the second pivot axis.

4. The radius actuator of claim 1 wherein the holder exhibits a recess for receiving the base plate, said recess being so dimensioned as to allow a displacement and tilting of the base plate therein.

5. The radius actuator of claim 4 wherein the recess and the base plate are each of square configuration.

6. The radius actuator of claim 1 wherein the holder has a key-distant backside, said mounting means including a ring-shaped plate threadably engaged in the backside for closing the holder, said spring extending in the holder between the base plate and the ring-shaped plate.

* * * * *